US009969052B2

(12) United States Patent
Bonnet et al.

(10) Patent No.: US 9,969,052 B2
(45) Date of Patent: May 15, 2018

(54) SANDING DEVICE INCLUDING MEANS FOR CHANGING A SANDING DISK

(71) Applicant: Universite De Nantes, Nantes (FR)

(72) Inventors: Samuel Bonnet, Pont-Saint-Martin (FR); Sébastien Garnier, Opio (FR); Sébastien Le Loch, Suce sur Erdre (FR); Benoît Furet, Nantes (FR); Guillaume Gallot, Nantes (FR)

(73) Assignee: Universite De Nantes (FR)

( * ) Notice: Subject to any disclaimer, the term of this patent is extended or adjusted under 35 U.S.C. 154(b) by 432 days.

(21) Appl. No.: 14/651,049

(22) PCT Filed: Dec. 9, 2013

(86) PCT No.: PCT/EP2013/075974
§ 371 (c)(1),
(2) Date: Sep. 28, 2015

(87) PCT Pub. No.: WO2014/090753
PCT Pub. Date: Jun. 19, 2014

(65) Prior Publication Data

US 2016/0039067 A1 Feb. 11, 2016

(30) Foreign Application Priority Data

Dec. 10, 2012 (FR) ..... 12 61816

(51) Int. Cl.
*B24B 45/00* (2006.01)
*B24D 9/08* (2006.01)
(Continued)

(52) U.S. Cl.
CPC ..... *B24B 45/006* (2013.01); *B24B 23/046* (2013.01); *B24B 55/06* (2013.01); *B24D 9/085* (2013.01)

(58) Field of Classification Search
CPC ..... B24B 23/046; B24B 45/006; B24B 55/06; B24D 9/085
See application file for complete search history.

(56) References Cited

U.S. PATENT DOCUMENTS 3,623,281 A * 11/1971 Moffat ..... B24B 45/006 451/509
5,231,803 A 8/1993 Lanzer
(Continued)

FOREIGN PATENT DOCUMENTS

DE 102006060310 A1 6/2008
FR 2636591 A * 3/1990 ..... B24D 9/08
(Continued)

OTHER PUBLICATIONS

WO 2008074553 A1—Jun. 2008—English Machine Translation.*
(Continued)

*Primary Examiner* — Marc Carlson
(74) *Attorney, Agent, or Firm* — Lerner, David, Littenberg, Krumholz & Mentlik, LLP

(57) ABSTRACT

The invention relates to a sanding assembly including a sanding device (100) comprising a plate (110) for supporting a sanding disk (10) and motor-driven means (140) suitable for moving the supporting plate (110), characterized in that the supporting plate (110) comprises two notches (114, 116) distributed angularly along the periphery thereof, a first notch (114) for engaging with a positioning module (200) and a second notch (116) for engaging with a pulling jaw (400), and a module (500) for verifying the presence of the sanding disk.

11 Claims, 4 Drawing Sheets

(51) Int. Cl.
*B24B 55/06* (2006.01)
*B24B 23/04* (2006.01)

(56) References Cited

U.S. PATENT DOCUMENTS

| | | | | |
|---|---|---|---|---|
| 6,116,996 | A * | 9/2000 | Yanase | B24B 23/02 451/359 |
| 2007/0018413 | A1* | 1/2007 | Allemann | B24B 45/006 279/143 |
| 2007/0167119 | A1* | 7/2007 | Momosaki | B24B 45/006 451/359 |

FOREIGN PATENT DOCUMENTS

| | | | | |
|---|---|---|---|---|
| FR | 2907358 | A1 * | 4/2008 | B24D 9/085 |
| FR | 2942735 | A1 | 9/2010 | |
| WO | WO 2008074553 | A1 * | 6/2008 | B24B 23/03 |

OTHER PUBLICATIONS

International Search Report for Application No. PCT/EP2013/075974 dated May 9, 2014.
French Search Report for Application No. FR 1261816 dated Aug. 26, 2013.

* cited by examiner

SANDING DEVICE INCLUDING MEANS FOR CHANGING A SANDING DISK

CROSS REFERENCE TO RELATED APPLICATIONS

The present application is a national phase entry under 35 U.S.C. § 371 of International Application No. PCT/EP2013/075974, filed Dec. 9, 2013, published in French, which claims priority from French Patent Application No. 1261816, filed Dec. 10, 2012, the disclosures of which are incorporated by reference herein.

TECHNICAL FIELD

The present invention concerns the field of sanding devices. More specifically, the present invention concerns a sanding device comprising means for changing the abrasive disc precisely and autonomously.

Still more specifically, the invention is particularly applicable to orbital sanders including means for sucking dust through a supporting plate and through the abrasive disc.

PRIOR ART

Various sanding devices and means for changing their abrasive discs have already been proposed.

Examples of such known devices are found in documents FR 2 942 735, U.S. Pat. No. 5,231,803 and GB 2 352 417.

AIM OF THE INVENTION

A first aim of the present invention is to propose means for guaranteeing reliable operation over time, despite operating in a difficult environment due to dust from sanding.

Another goal of the invention is to provide means for providing precise relative positioning of a plate for supporting an abrasive disc in relation to spare abrasive discs for placing on said supporting plate.

DESCRIPTION OF THE INVENTION

The aforementioned goals are achieved with the present invention using a sanding assembly comprising an abrasive disc, comprising a plate for supporting an abrasive disc and motor-driven means suitable for moving the supporting plate, characterized by the fact that the supporting plate comprises two notches distributed angularly along the periphery thereof, a first notch for engaging with a positioning module and a second notch for engaging with a pulling jaw and a module for verifying the presence of an abrasive disc.

BRIEF DESCRIPTION OF THE FIGURES

Other features, aims and advantages of the present invention will become apparent on reading the following detailed description, and with reference to the appended drawings, given by way of non-limiting example and wherein.

DETAILED DESCRIPTION OF THE INVENTION

Figure 1:
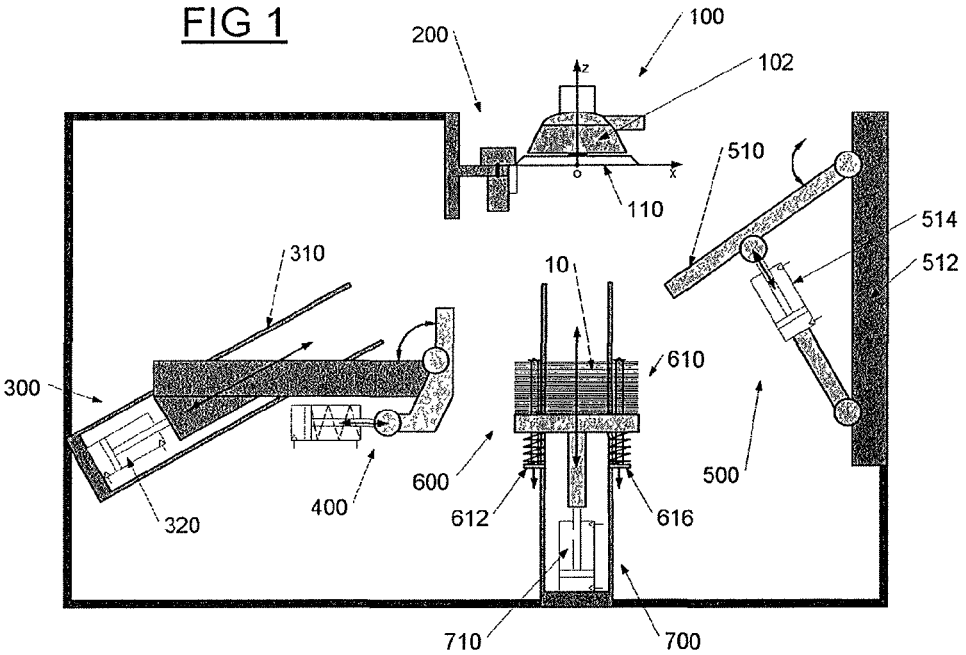
FIG. 1 illustrates a general view of an assembly for changing a perforated abrasive disc on an orbital sander, in accordance with the present invention, FIG. 2 schematically illustrates the general structure of an orbital sander, FIGS. 3 and 4 respectively illustrate a plate in accordance with the present invention and a perforated abrasive disc intended to be fastened onto such a plate.

FIG. 1 represents an assembly suitable for ensuring automatic changing of perforated abrasive discs 10 placed on the supporting plate 110 of an orbital sander 100.

This assembly constitutes a complete and autonomous system making it possible, after simple positioning of the orbital sanding effector 100 by automated means, to angularly orient the plate 110 of the sander 100, to remove a used perforated disc 10, to position a new perforated disc 10 on the plate, to verify at any time the presence or absence of a perforated disc 10 on the plate 110 and to store a set of new perforated discs 10 in a magazine. The system guarantees precise positioning of the new perforated disc 10 by making the suction holes provided in the abrasive disc 10 and the plate 110 respectively coincide.

The assembly for changing an abrasive disc illustrated in the appended FIG. 1 comprises 6 subassemblies:

A system 200 for indexing the plate 110,

An elevator system 300 for pulling,

A system 400 for pulling off the disc 10,

A system 500 for verifying the presence of a disc 10,

A magazine system 600 for new discs 10,

An elevator system 700 for the magazine of new discs 10.

The assembly illustrated in FIG. 1 is designed to be compact enough to be embedded on movable means or on the rail of a 7-axis industrial robot for example.

The 6 aforementioned subassemblies are positioned to act in succession in order to pull off a used abrasive disc 10 placed on the plate 110 of an orbital sander 100, then place a new disc 10 on the plate 110, from a single and constant position of the sander 100 (reference frame O; X; Z) and of its automated arm. In the remainder of the description, this position of the sander will be referred to as "single position" for the sake of simplicity.

The respective position of each of the 6 subassemblies makes it possible to individually actuate each of these subassemblies in a sequential manner without interfering with the other subassemblies.

The sander 100 is placed on an automated arm suitable for sequentially moving the sander between the abrasive disc 10 changing position illustrated in FIG. 1 and a work position remote from the disc changing sub-assembly, wherein the abrasive disc borne by the plate 110 is bearing on a part to be sanded and driven to sand this part.

The structure and operation of such an automated arm are known per se and can be the subject of many embodiments. The automated arm is therefore not illustrated in the appended figures and will not be described in further detail below.

Figure 2:
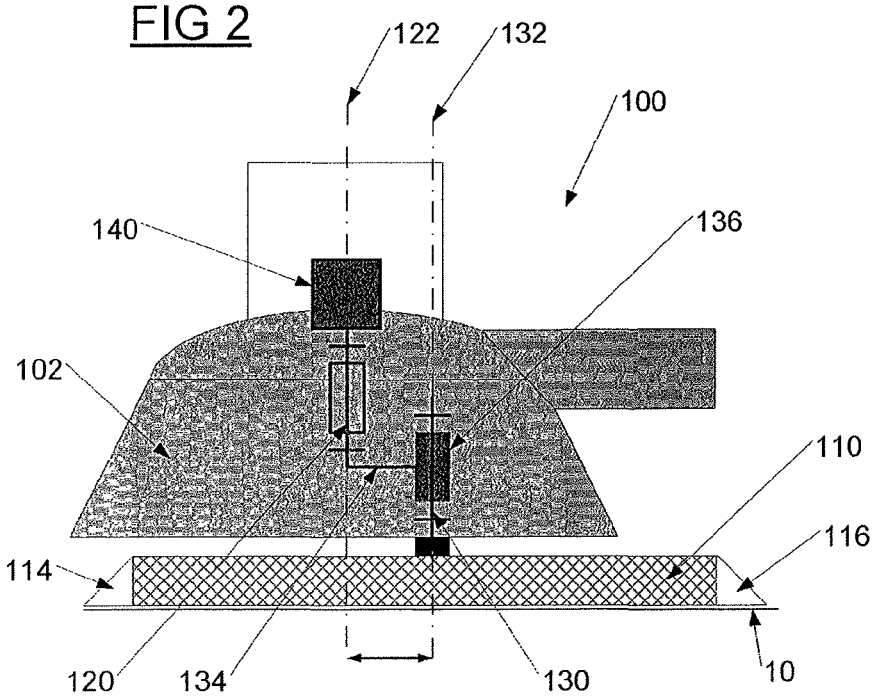

The orbital sander 100 schematized in FIG. 2 has a housing 102 carrying a drive shaft 120 centered on an axis 122 and a driven shaft 130 connected to the plate 110 and itself centered on an axis 132 parallel to the axis 122 of the drive shaft 120, but off-center with respect to this axis 122 by a few millimeters.

The drive shaft 120 is rotated about the axis 122 by the motor 140 of the sander. The driven shaft 130 is rotatably mounted in a bearing 136 connected to the drive shaft 120 by a rigid radial arm 134 transverse to the axis 122. Thus when the drive shaft 120 is rotated about the axis 122, the bearing 136 describes an orbital movement about the axis 122. The driven shaft 130 is continually rotationally free in the bearing 136, about its axis 132. The relative rotational movement of the driven shaft 130 in relation to the bearing 136 depends on the resistive forces applied by the sanded part to the abrasive disc 10 connected to the plate 110.

At rest, the driving shaft 120 becomes free and can be turned manually.

The supporting plate 110 is carried by the free end of the driven shaft 130 emerging from the housing 102. It extends perpendicularly to the axis 132. The plate 110 is adapted to receive and hold an abrasive disc 10 by any appropriate means, for example a system of Velcro/hook type or any equivalent means.

The plate 110 and the disc 10 are equipped with respective through perforations 112, 12. The arrangement of the perforations 12 provided on the disc 10 is identical to the arrangement of the perforations 112 provided on plate 110 to allow the evacuation of dust by suction during operation. Each perforation 12 of the disc 10 must be perfectly aligned with a perforation 112 of the plate 110 to allow an optimal level of suction.

Figure 3:
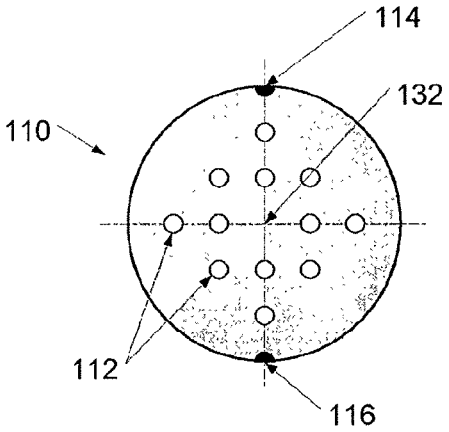
Figure 4:
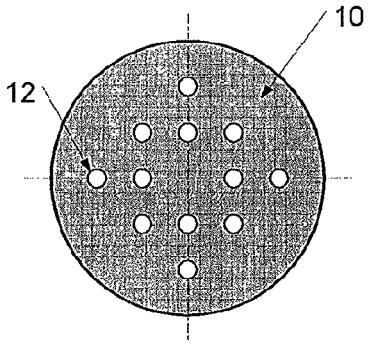

The appended FIGS. 3 and 4 represent an arrangement with 12 perforations respectively in each disc 10 and in the plate 110, but of course the present invention is not limited to this particular arrangement.

As previously indicated, according to the invention the supporting plate 110 includes two notches 114, 116 angularly distributed over its edge. The two notches extend over the whole thickness of the plate 110 and open onto the peripheral section of the plate.

Preferably, as can be seen in FIG. 3, the two notches 114, 116 are symmetrical and diametrically opposed.

A first notch 114 is designed to engage with the positioning or indexing module 200 and the second notch 116 is designed to engage with a pulling jaw 410 and the module 500 for verifying the presence of the abrasive disc.

The inventors observed that the production of indexing means on the plate 110 in the form of a removal of material at the 2 symmetrical notches 114, 116, has no dynamic or vibrational effect on the orbital sander in rotation.

The means 200 for positioning the free axis 130 of the plate 110 will now be described, illustrated in the appended FIGS. 5 and 6.

As seen in FIG. 1, these means 200 are preferably placed in the upper part of the disc changing assembly, at the station occupied by the sander 100 in the position for pulling out a worn disc and positioning a new disc 10.

The presence of 2 free shafts 120, 130 complicates the positioning of the plate 110 and therefore its suction holes 112, since the movement of the housing 102 using the automated arm does not make it possible to act directly on the position of the shaft 130, the latter being capable of free planetary movement about the axis 122.

Figure 5:
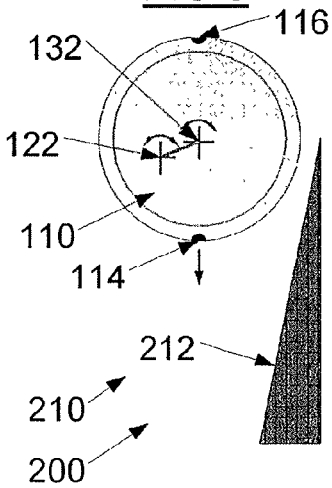
FIGS. 5 and 6 illustrate means for prepositioning the plate of the orbital sander with regard to the assembly for changing the abrasive disc, at two successive stages of their operation.
Figure 6:
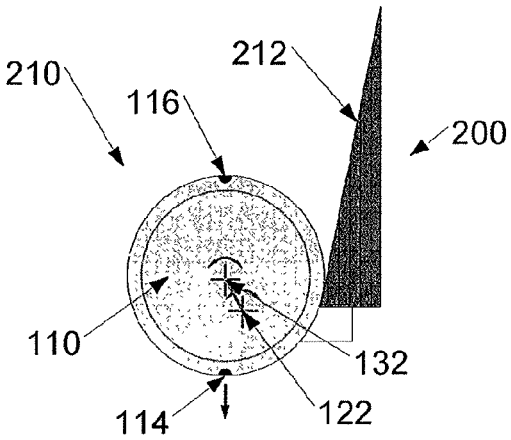
Figure 7:
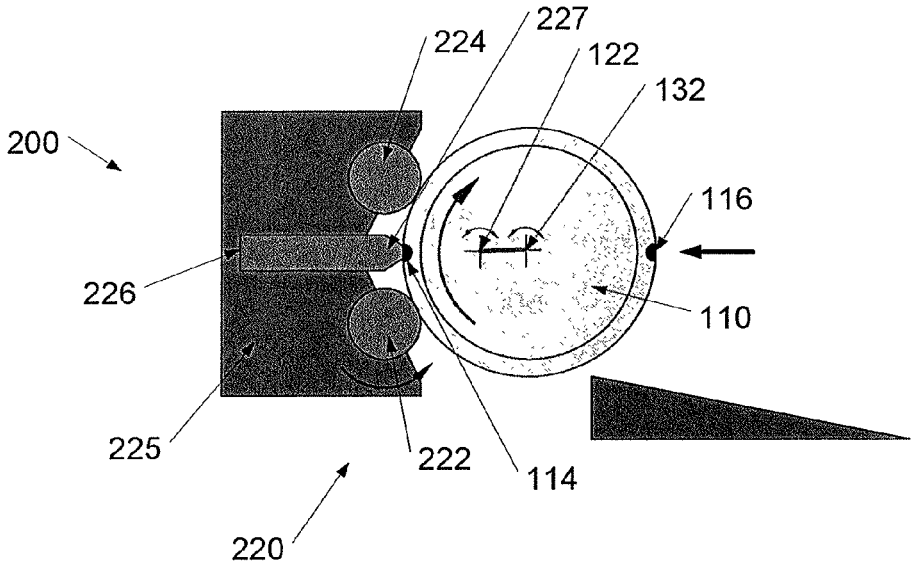
FIG. 7 illustrates a sub-assembly for orienting the plate of the orbital sander.

To meet this objective of positioning the plate 110, according to the invention provision is made for a prepositioning station 210 illustrated in FIGS. 5 and 6 including an inclined surface 212 and a station for precise angular orientation 220 illustrated in FIG. 7 including two rollers 222, 224, one of which is driven by a motor.

The inclined surface 212 is located along a rectilinear section of the approach trajectory of the plate 110 when the automated arm (not represented in the appended figures as indicated previously) moves the sander 100 in the single position (reference frame O; X; Z) that it must occupy in the disc changing assembly. However, the inclined surface 212 is not parallel to the main direction of this section, but converges on the median plane of the plate trajectory, in the direction of the aforementioned single position. In the remainder of the description, the aforementioned plane will be called "median trajectory plane". This plane is parallel to the plane in FIGS. 1 and 8 to 10 and perpendicular to the plane in FIGS. 5 to 7.

Thus, when the automated arm moves the sander 100 in the aforementioned single position, the periphery of the plate 110 comes into contact with the inclined surface 212. Thus the plate 110 tends to be braked and the shaft 130 of the plate 110 is oriented to the rear of the direction of advancement, in relation to the drive shaft 120, as seen in the comparative examination of FIGS. 5 and 6.

The two rollers 222 and 224 are carried by a mount 225 on either side of the median trajectory plane of the plate 110. Their axes of rotation are parallel to the axes 122 and 132. Thus at the end of its movement the plate 110 comes into contact with the 2 rollers 222 and 224 and the driven shaft 130 of the plate 110 finishes its precise positioning to the rear of the driven shaft 120, the axis 132 and the axis 122 being in a plane that coincides with the axis of the forward direction as can be seen in FIG. 7 and which corresponds to the median trajectory plane.

The motor-driven roller 222, in contact with the periphery of the plate 110, then makes it possible to rotate the plate 110 about the axis 132 (and thus its perforated abrasive disc 10) to angularly orient the plate 110.

A sensor 226 preferably comprising a mechanical probe 227 located between the two rollers 222 and 224, in the median trajectory plane, detects one of the two notches 114 of the plate 110 and stops the rotation of the roller 222 when the probe 227 is placed opposite the notch 114, then ending the positioning of the suction holes 12 and 112. The detection of the notch 114 can be done in various ways, for example but not necessarily by penetration of the mechanical probe into the notch 114.

The orbital sander 100 then occupies the desired precise position in relation to the assemblies 300, 400, 500, 600 and 700 for pulling off a worn disc 10 and putting a new disc in place 10.

Figure 8:
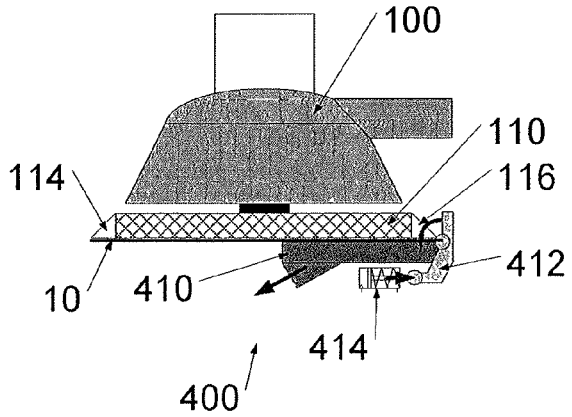
FIG. 8 illustrates a sub-assembly for pulling off a perforated disc, in accordance with the present invention.

The disc pulling sub-assembly 400 illustrated in FIG. 8 will now be described.

At rest this disc pulling sub-assembly 400, combined with the elevating sub-assembly 300, is placed laterally on a lower stage than the unit occupied by the sander 100 in the single position.

The pulling sub-assembly 400 comprises a plate 410 which sets a jaw 412 in motion. The plate 410 and the jaw 412 together form a disc-gripping clamp. The jaws 412 can be moved by any appropriate means, for example a jack 414, between a rest position, as illustrated in FIG. 8, wherein, the jaws 412 being distant from the plate 410, for example orthogonal to the plate 410, the clamp is open, and a work position wherein the jaws 412 are pressed flat against the upper surface of the plate 410 and the clamp is consequently shut.

The elevator 300 can be subject to numerous embodiments. It preferably comprises a guide 310 inclined with respect to the vertical and centered on the median trajectory plane, combined with a jack 320. The guide 310 and the jack 320 are suitable for moving the plate 410 and the pulling sub-assembly 400, in the median trajectory plane, between a retracted rest position represented in FIG. 1 wherein the pulling sub-assembly 400 waits in a lateral position lower than the sander 100, and a work position represented in FIG. 8 wherein the plate 410 is moved while bearing against the lower surface of the plate 110, the jaws 412 being placed opposite the notch 116.

In this position, the actuation of the jack 414 leads to the shutting of the clamp by the pivoting of the jaws 412 (which are placed in the notch 116), and the clamping of the edge of a worn disc 10 at the notch 116.

Retracting the jack 320 makes it possible to bring the plate 410 down into the shut position of the clamp and thus to pull off the disc 10.

The sub-assembly 500 for verifying the presence or absence of the disc will now be described, with reference to FIG. 9.

This verification sub-assembly 500 is also placed in the rest position at a stage lower than the unit occupied by the sander 100 in the single position, and preferably in a position diametrically opposed to the pulling module 400 with respect to the vertical of the sander 100.

Figure 9:
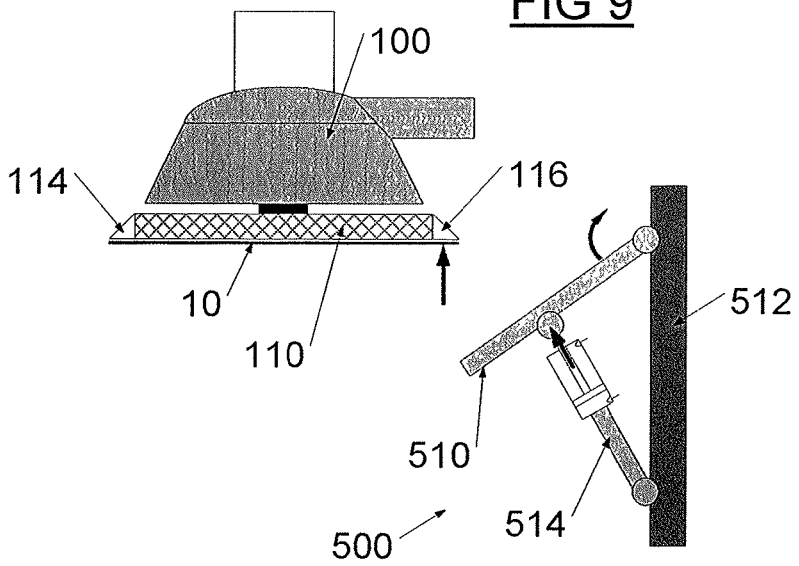
FIG. 9 illustrates a sub-assembly for verifying a perforated disc, in accordance with the present invention.

The verification module 500 comprises a rod 510 rotatably mounted on a baseplate 512 and moved by any appropriate means, for example a jack 514, between a rest position, as illustrated in FIG. 9 wherein the rod 510 is distant from the plate 110, and a work position wherein the rod 510 is moved toward the plate 110 facing the notch 116. During this movement the rod 510 is moved in the median trajectory plane.

The person skilled in the art will understand that when a disc 10 is present on the plate 110, the end of the rod 510 abuts the disc 10. On the other hand, in the absence of a disc 10, the rod 510 can engage with the notch 116. Detecting the amplitude of the track of the rod 510 consequently makes it possible to verify the absence or presence of a disc 10 on the plate 110. This amplitude detection can be carried out using any appropriate means, for example a bulb of "Flexible Blade Switch" type.

Preferably the verification module 500 is actuated, firstly after pulling off a disc 10 in order to verify that the pulling has indeed been carried out and secondly after putting a new disc in place in order to verify that the placing of this new disc has indeed been carried out.

This verification step is essential to guarantee that the plate 110 does not risk being put against a part to be sanded, while being without an abrasive disc 10. This is because, in the opposite case, the movement of the plate 110 on said part to be sanded risks damaging the latter.

Figure 10:
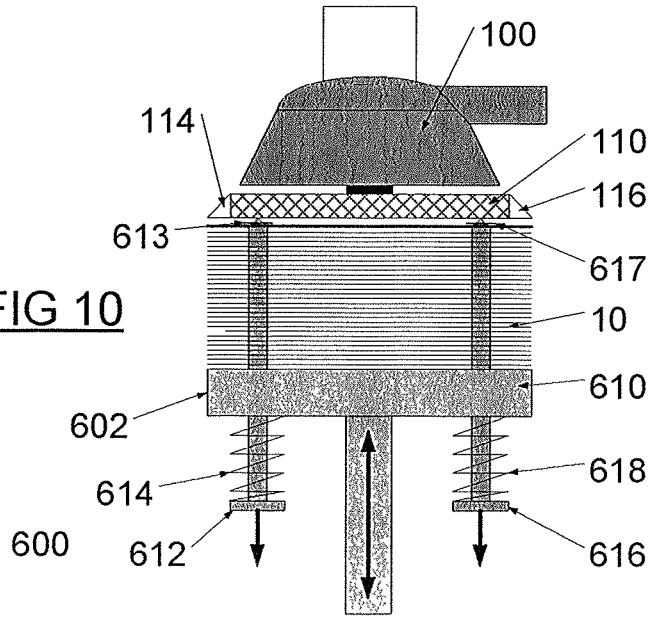
FIG. 10 illustrates a sub-assembly for positioning a perforated disc facing the supporting plate.

The module 600 for positioning a disc 10 on the plate 110 and storing spare discs, illustrated in FIG. 10, will now be described.

This sub-assembly 600 is placed under the unit occupied by the sander 100 in the single position, vertically to the latter.

After pulling a worn disc 10, a new disc 10 must be placed against the plate 110. A magazine system 610 makes it possible to store a set of abrasive discs 10 horizontally stacked on a base 602. The discs 10 are pre-positioned by an operator 2 on two vertical centering rods 612, 616 each equipped, at their upper free end, with a clip 613, 617 for holding abrasive discs 10 and at their lower end, with a return spring 614, 618.

The clips 613, 617 are adapted to permit the removal of a disc 10 when the latter adheres to the plate 110 while preventing removal of the disc lying beneath.

The centering rods 612, 616 are mounted to be vertically sliding on the base 602 and pressed downward by the springs 614, 618 in relation to the base 602.

At the request of a control system, an elevator system 700, for example a jack 710 lying beneath the magazine 610, makes it possible to push the magazine 610 upward and to present a new tool on the plate 110 without a disc 10.

The angular orientation of the new disc 10 in relation to the plate 110 and, consequently, a perfect alignment of the respective perforations 12 and 112 provided on the disc 10 and on the plate 110 are guaranteed from the moment that the plate is positioned with precision in relation to the sensor 226 and the magazine 610 is itself oriented with precision in relation to the frame of reference of the sensor 226.

After contact of the abrasive disc 10 present on the summit of the reserve in the magazine 610, with the attachment system provided on the lower surface of the plate 110, for example a system of velcro/catch type as previously indicated, the descent of the magazine 610 by control of the jack 710 separates this disc 10 from the magazine 610.

As previously described, once a new disc 10 is arranged under the plate 110 of the sander 100, the verification system 500 makes sure of the presence of the disc 10 via the previously described procedure of moving the rod 510 and measuring its track.

The assembly for changing the new disc then permits the automated arm to retract the orbital sander 100 to continue its sanding operation.

In a variant, the device in accordance with the present invention can include an additional actuator of slide type to present several magazines 610 of abrasive discs with different granulometry, for example, selectively under the plate 110 of the sander 100.

ADVANTAGES OF THE INVENTION

The operation of surface preparation by orbital sanding is increasingly automated for repetitive tasks, particularly by industrial robots. Whether it is for the production of parts of large size in small runs or the production of smaller parts in large runs, the automation of these manual tasks has many benefits: in particular it alleviates the risk to the operator of musculoskeletal or industrial health problems (dust, noise etc.) and increases productivity.

The proposed assembly according to the invention allows total automation of the changing of the abrasive disc and guarantees precise positioning of abrasive discs on the supporting plate of the sanding device itself to ensure optimal suction of sanded dust and prevent the application of the sanding supporting plate in the presence of an abrasive disc on a surface to be sanded, thus avoiding any risk of deterioration of the surface to be sanded.

The assembly in accordance with the present invention is further noteworthy for the following points:

- by virtue of the positioning of these component parts it is an autonomous and compact abrasive disc changer,
- in particular, it allows a method of random orbital abrasion with perforated discs,
- by the presence of symmetrical indexing notches it enables the avoidance of any dynamic perturbation leading to harmful vibration phenomena, when compared with known solutions of the prior art, it permits many changes of abrasive disc, enabling the sanding of parts of large dimensions (for example and without being exclusive in the nautical, wind turbine or aeronautical fields).

The invention claimed is:

1. A sanding assembly for use with abrasive discs, the sanding assembly comprising:

a sanding device, the sanding device comprising:

a supporting plate for supporting an abrasive disc; and a motor suitable for moving the supporting plate, wherein the sanding assembly further comprises:

a positioning sub-assembly for indexing the supporting plate, a pulling sub-assembly for pulling an abrasive disc off the supporting plate, a pulling elevator for positioning the pulling sub-assembly, a verification sub-assembly for verifying a presence of an abrasive disc, a magazine for storing new abrasive discs, and a magazine elevator for moving new abrasive discs wherein the supporting plate comprises two notches distributed angularly along a periphery thereof, a first notch for engaging with the positioning sub-assembly and a second notch for engaging with the pulling sub-assembly and the verification sub-assembly.

2. The assembly according to claim 1, wherein the sanding device is an orbital sander having a housing carrying a drive shaft centered on an axis and a driven shaft connected to the supporting plate and itself centered on a plate axis parallel to the axis of the drive shaft but off-center with respect to this axis by a few millimeters, the driven shaft being mounted rotationally free in a bearing connected to the drive shaft by a rigid radial arm transversal to the axis of the drive shaft.

3. The assembly according to claim 1, further comprising an abrasive disc, wherein the supporting plate and the abrasive disc are equipped with respective through perforations of identical disposition.

4. The assembly according to claim 1, wherein the two notches are symmetrical and diametrically opposed on the supporting plate.

5. The assembly according to claim 1, wherein the positioning sub-assembly includes an inclined surface located along a rectilinear section of an approach trajectory of the supporting plate in such a way that the periphery of the supporting plate comes into contact with the inclined surface.

6. The assembly according to claim 1, wherein the positioning sub-assembly includes two rollers carried by a mount on either side of a median trajectory plane of the supporting plate, one of the rollers being motor-driven and connected to a sensor comprising a mechanical probe, adapted to detect one of the two notches of the supporting plate.

7. The assembly according to claim 1, wherein the pulling sub-assembly comprises a motor-driven pulling jaw for gripping an abrasive disc and a jack adapted to move the pulling jaw between a rest position distant from the supporting plate and a work position wherein the pulling jaw is placed facing the second notch.

8. The assembly according to claim 1, wherein the verification sub-assembly comprises a rod rotatably mounted on a baseplate and moved by a jack, between a retracted rest position and a work position wherein the rod is moved toward the supporting plate facing the second notch.

9. The assembly according to claim 1, wherein the pulling sub-assembly comprises a pulling jaw movably guided in a median trajectory plane and wherein the verification sub-assembly comprises a detection rod movably guided in the median trajectory plane, the pulling sub-assembly and the verification sub-assembly being substantially diametrically opposed with respect to a vertical axis of the sanding device and wherein the magazine for storing new abrasive discs is connected to the magazine elevator underlying the sanding device vertically to the latter.

10. A sanding assembly for use with abrasive discs, the sanding assembly comprising a supporting plate for supporting an abrasive disc and a motor suitable for moving the supporting plate, wherein the supporting plate comprises two notches distributed angularly along a periphery thereof, a first notch for engaging with a positioning module and a second notch for engaging with a pulling jaw and a module for verifying a presence of an abrasive disc, wherein the positioning module includes two rollers carried by a mount on either side of a median trajectory plane of the supporting plate, one of the rollers being motor-driven and connected to a sensor comprising a mechanical probe, adapted to detect one of the two notches of the supporting plate.

11. A sanding assembly for use with abrasive discs, the sanding assembly comprising a supporting plate for supporting an abrasive disc and a motor suitable for moving the supporting plate, wherein the supporting plate comprises two notches distributed angularly along a periphery thereof, a first notch for engaging with a positioning module and a second notch for engaging with a pulling jaw and a module for verifying a presence of an abrasive disc, the sanding assembly further comprising a pulling sub-assembly comprising a motor-driven jaw for gripping an abrasive disc and a jack adapted to move the jaw between a rest position distant from the supporting plate and a work position wherein the jaw is placed facing the second notch.

* * * * *